United States Patent [19]

Niemann et al.

[11] Patent Number: 4,696,169

[45] Date of Patent: Sep. 29, 1987

[54] CRYOGENIC SUPPORT MEMBER

[75] Inventors: Ralph C. Niemann, Downers Grove; John D. Gonczy, Oak Lawn; Thomas H. Nicol, Aurora, all of Ill.

[73] Assignee: The United States of America as represented by the United States Department of Energy, Washington, D.C.

[21] Appl. No.: 863,492

[22] Filed: May 15, 1986

[51] Int. Cl.[4] ..... F25B 19/00

[52] U.S. Cl. ..... 62/514 R; 29/447; 248/637

[58] Field of Search ..... 62/514 R, 295; 285/381; 248/637, DIG. 1; 29/447, DIG. 35

[56] References Cited

U.S. PATENT DOCUMENTS

| | | | |
|---|---|---|---|
| 1,735,563 | 11/1929 | Deckard . | |
| 3,731,367 | 5/1973 | Laussermaier et al. | 29/DIG. 35 X |
| 3,805,567 | 4/1974 | Agius-Siherco | 285/381 X |
| 3,814,361 | 6/1974 | Gabron et al. | 248/DIG. 1 X |
| 4,074,412 | 2/1978 | Miskic | 29/447 X |
| 4,169,477 | 10/1979 | Bokros | 285/381 X |
| 4,325,530 | 4/1982 | Niemann et al. | 248/317 |
| 4,332,073 | 6/1982 | Yoshida et al. | 29/447 X |
| 4,377,335 | 3/1983 | Fannon et al. | 29/447 X |
| 4,448,449 | 5/1984 | Halling et al. | 285/381 X |
| 4,470,415 | 9/1984 | Wozniak | 29/DIG. 35 X |
| 4,491,347 | 1/1985 | Gustafson | 285/381 X |
| 4,499,646 | 2/1985 | Allor et al. | 29/447 |

OTHER PUBLICATIONS

"Energy Saver Crystal Support Material Creep Measurements," F. Markley, Fermilab, Jan. 1984, p. 1-B.

"Creep Analysis of Laminates," R. L. Foye, American Society for Testing and Materials, ASTM STP 580, 1975, pp. 381-395.

"Fiberglass-Epoxy in a Conical Superconducting Field Magnet Support," Schramm et al., International Cryogenic Materials Conf., Aug. 1977, pp. 271-278.

*Primary Examiner*—Albert J. Makay
*Assistant Examiner*—Steven E. Warner
*Attorney, Agent, or Firm*—Gustavo Siller, Jr.; Paul A. Gottlieb; Judson R. Hightower

[57] ABSTRACT

A cryogenic support member is comprised of a non-metallic rod having a depression in at least one end and a metallic end connection assembled to the rod. The metallic end connection comprises a metallic plug which conforms to the shape and is disposed in the depression and a metallic sleeve is disposed over the rod and plug. The plug and the sleeve are shrink-fitted to the depression in the rod to form a connection good in compression, tension and bending.

19 Claims, 7 Drawing Figures

CRYOGENIC SUPPORT MEMBER

CONTRACTUAL ORIGIN OF THE INVENTION

The U.S. Government has rights to this invention pursuant to the Contract No. DE-AC02-76CH03000 between the U.S. Department of Energy and Universities Research Association, Inc.

BACKGROUND OF THE INVENTION

The present invention relates generally to a cryogenic support member and more particularly to a cryogenic support member which comprises a fiber reinforced plastic (FRP) tube with metallic end connections.

Conceptual design for a proton-proton collider, called the Superconducting Super Collider (SSC) are underway. The proposed particle collider for high energy physics research will employ superconducting accelerator rings. The SSC incorporates two adjacent 32 km diameter accelerator rings in a common tunnel. The rings consist of dipole magnets for bending, quadrupole magnets for focusing and special magnets for correction. The ring magnets must provide the specified magnetic function, have low refrigeration load, operate with very high reliability and be manufacturable at a low cost.

The cryostat features are critical to the SSC design. The cryostat must function reliably during transit, transient, steady-state and upset operating conditions. The major components of the cryostat are the cold mass assembly, thermal shields, insulation, vacuum vessel, interconnections and the suspension system.

The magnet suspension system functions under a variety of conditions which include assembly, shipping and installation, cooldown and warmup, steady-state operation and upset conditions. The suspension system must have the attributes of low cost; installation and adjustment ease; high reliability; positional stability; and low heat leak.

The cold mass assembly and shield assemblies with their distributed static and dynamic loads are supported relative to the vacuum vessel at several points. The number and location of these important points is determined by the beam deflection of the cold mass assembly and the need to optimize the number of support points for reasons of fabrication ease and low heat leak. The suspension system will employ several post-type supports and an independent anchor at cryostat mid-length for axial motion restraint.

The SSC refrigeration requirements are very stringent and result in low heat leak budgets. The heat leak contribution of the suspension system must be minimized to optimize cryostat design.

The use of the tubes or columns of fiberglass/epoxy to support superconducting magnets and other cryogenic objects is well established technology. Fiberglass-/epoxy material, commercially designated as G-10 or G-11, has a very low thermal conductivity and has good compressive and tensile strength at low temperatures. In this respect, U.S. Pat. No. 4,325,530, entitled "Cryogenic Structural Support", illustrates the use of a FRP laminate in a structural support member in tension.

It is desirable to have some means for securing the support member to the magnet system at one end and to a foundation at the other end of the support member. Typically, this is achieved by attaching a metallic end connection to the ends of the FRP tube. The metallic end connections can then be fastened, bolted, welded, or chemically bonded to the magnet system or the foundation. Illustrative of this design is the support member shown by Timmerhaus et al., "ADVANCES OF CRYOGENIC ENGINEERING", Proc. International Cryogenic Materials Conf., 2nd Vol. 24, using a bolted connection.

The prior art, however, fails to disclose a method of joining the FRP tube to the metallic end connections which will withstand the repeated mechanical and thermal stresses imposed on the support member by a system such as the SSC. The method which have been heretofore used to join the FRP tube to the metallic end connections have severe limitations. The use of epoxy bonding to join the two materials leads to a joint which may crack upon thermal or mechanical cycling. The use of screws or bolts to fasten the metallic connection to the FRP tube leads to penetrations in the FRP tube. Such penetrations can cause the failure of the tube upon repeated load cycling. The use of the threaded connections to join the metallic connection to the FRP tube also produces a poor joint. The threads in the FRP tube can fail with repeated load cycling. The present invention overcomes the failings of the teachings of the prior art by using a metallic end connection which is shrink-fitted to an FRP tube. The present invention thus, avoids the problem of epoxy bonding which could crack upon thermal cycling. The joint is non-invasive and the FRP material strength is not reduced by pentrations, threads, etc. The thermal interference joint produced by the shrink-fitting the metallic and FRP components is good in tension, compression and bending. The joint also generates excellent thermal contact between the materials and, thus, produces a very good heat intercept.

Shrink-fit techniques have heretofore been used in a variety of applications. U.S. Pat. No. 1,735,563, entitled "Method of Securing Metal End Couplings On Tubular Members", discloses a method of securing metal end couplings to a metal tube. A plug is shrink-fitted inside of the tube and metallic coupling. This patent, however, illustrates the distrust in the prior art in the strength of a shrink-fitted connection, as the component parts are forged, welded, or fused together in addition to the shrink-fitted connection. Further, this patent discloses only a method of joining two metallic parts. This patent does not address the problem of fatigue or creep effects which may come into play when an FRP or other non-metallic material is used. Creep effects in an FRP composites and laminates may pose a problem for an FRP member in compression or tension. Creep analysis have been performed by Foye, "Creep Analysis of Laminates Composite Reliablility", ASTM STP 580, American Society for Testing and Materials, 1975, pp. 381–395 and by Markley et al., "Energy Saver Cryostat Support Material Creep Measurements", 1984. It has been heretofore believed that creep effects would cause an FRP tube pinched between two metallic components to extrude out of the joint area.

U.S. Pat. No. 4,499,646 discloses a technique for joining a metallic shaft to a ceramic shaft using an expansion sleeve. An expansion sleeve is placed over a ceramic shaft and both parts are inserted into the hollow part of a metallic shaft. The end of the ceramic shaft is threaded and mated to the metal shaft. Upon heating, the expansion sleeve expands, further securing the ceramic shaft to the metallic shaft. This technique would be inoperative in the support member of the present invention, as the expansion sleeve functions only at elevated or heated temperatures. The support member of the present invention will operate below elevated temperatures.

The prior art discloses the use of shrink-fit techniques to join FRP material to metallic tubes. U.S. Pat. No. 3,731,367, entitled "Method of Assembling Compound Body", discloses that a metal tube may be cooled and inserted into an FRP tube and upon expansion of the metal tube, by subsequent heating to room temperature, the metal tube and the FRP tube are securely bonded together. This technique would be inoperative for the present invention. While this technique forms a strong compound body, subjecting the two members to loads applied in different directions would lead to a failure of the joints between the FRP tube and the metal tube. Thus, this connection would produce a poor metallic end connection for a support member, as the metallic end and FRP components will be subjected to forces acting in opposite directions. Additionally, cooling the compound body to cryogenic temperatures would lead to a weakened joint between the two tubes.

Shrink-fit processes have been used in a variety of other applications as exemplified by U.S. Pat. No. 4,074,412, entitled "Method of Repairing or Reinforceing Tubular Plastic Members"; U.S. Pat. No. 4,470,415, entitled "Sutureless Vascular Anastomosis Means and Method"; and U.S. Pat. No. 4,169,477, entitled "Anastomatic Couplings". These patents, however, do not disclose a joint which will be strong in compression, tension, and bending, nor do these patents disclose a joint which will be operative at cryogenic temperatures.

The joints of the cryogenic support member of the present invention generate excellent thermal contact between the materials and, thus, may be used as a very effective heat intercept. The use of heat intercepts in a cryogenic support member is illustrated in U.S. Pat. No. 4,325,530 and by Timmerhaus, et al., cited above. The heat intercepts utilized in the above devices either are epoxied to the FRP tube or are inserted between plies of laminate of the FRP. These methods of joining the heat intercept to the FRP member yields a heat intercept with a low thermal efficiency.

Therefore, in view of the above, it is an object of the present invention to provide a cryogenic support member which has a non-metallic member for support and metallic end connections.

It is another object of the present invention to provide a cryogenic support member wherein the coupling between the non-metallic member and the metallic end connection is good in tension, compression and flexure well above, and well below the temperature at which the coupling was assembled.

It is still another object of the present invention to provide a cryogenic support member in which a non-metallic member is not weakened by penetrations.

It is still another object of the present invention to provide a cryogenic support member wherein the non-metallic member is fiber reinforced plastic.

It is yet another object of the present invention to provide a cryogenic support member which has efficient heat intercepts.

Additional objects, advantages, and novel features of the invention will become apparent to those skilled in the art upon examination of the following or may be learned by practice of the invention. The objects and advantages of the invention may be realized and obtained by means of the instrumentalities and combinations particularly pointed out in the appended claims.

SUMMARY OF THE INVENTION

To achieve the foregoing and other objects in accordance with the purposes of the present invention, as embodied and broadly claimed herein, the cryogenic support member of this invention may comprise a non-metallic rod having a depression in at least one end, a metallic plug, and a metallic sleeve. The plug and the sleeve are shrink-fitted to the depression in the rod such that the plug is disposed inside the depression and the sleeve is disposed over the depression and the plug. The rod is claimed between the plug and the sleeve providing a joint between the metallic components and the non-metallic rod which is good in compression, tension and flexure.

DETAILED DESCRIPTION OF THE INVENTION

Figure 1:
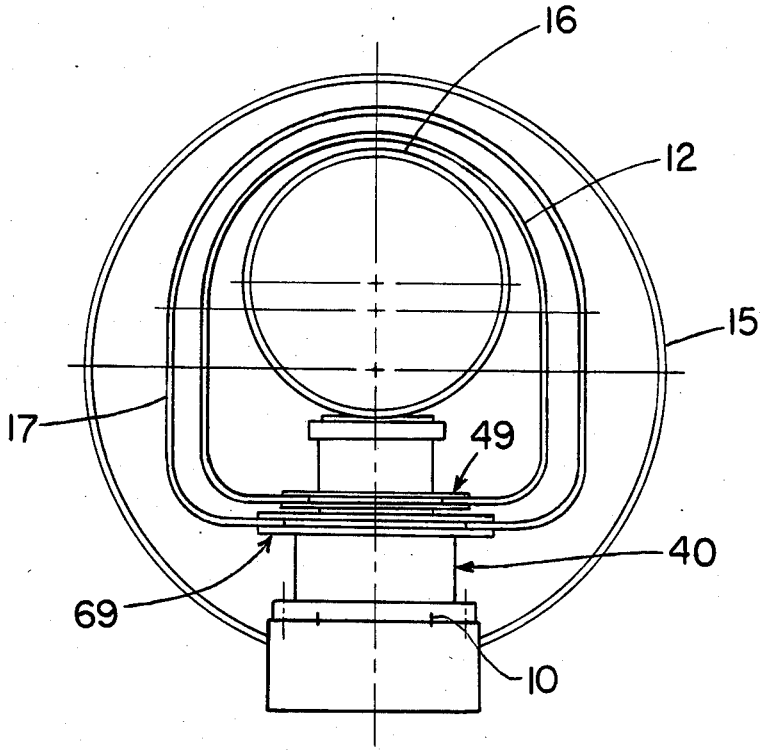
FIG. 1 represents a cross-section through an SSC magnetic cryostat supported by a cryogenic support member of the present invention.

Reference will now be made in detail to the present preferred embodiment of the invention, an example of which is illustrated in the accompanying drawings. Referring to FIG. 1, a three-section reentrant support post 40 supports the magnet cold mass assembly 16, thermal shield 12 and thermal shield 17. Thermal shield 12 is connected to a heat intercept 49 and second thermal shield 17 is connected to a second heat intercept 69. Support post 40 is secured to a foundation by securing means 10. The means of attaching the metallic end connection of the support poast 40 to a foundation may be welded means, chemically bonded means, bolts, or any other manner of attaching the metallic end connections to the foundation.

Figure 3:
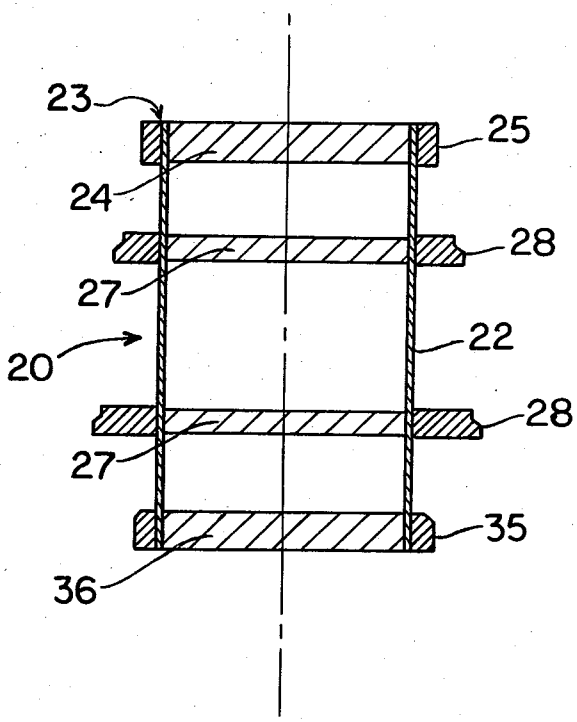
FIG. 3 represents a cross-sectional view through lines 3—3 of the cryogenic support member shown in FIG. 2.
Figure 2:
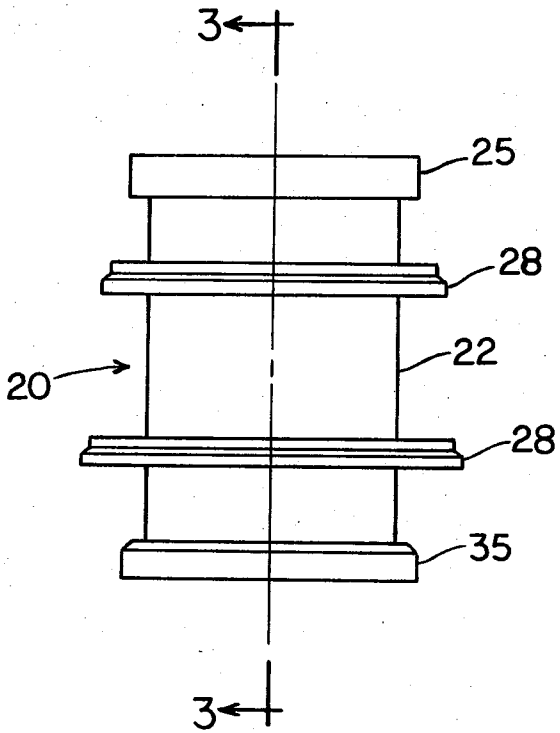
FIG. 2 represents a single section uniform tube, cryogenic support member of the present invention.

FIGS. 2 and 3 show a single section uniform tube cryogenic support member of the present invention. A non-metallic rod 22 having a depression 23 in at least one end is attached to metallic plug 24 and metallic sleeve 25. A depression, here, is defined as a hole or aperture in the end of the rod which assumes the same geometric shape as that of the plug. As will be recognized by those skilled in the art, rod 22 may be made of any material which has a low thermal conductivity. It is generally found that metallic elements have a higher thermal conductivity than non-metallic elements. Hereinafter, materials which have a low thermal conductivity for cryogenic purposes will be referred to as non-metallic materials and materials with a high thermal conductivity as metallic materials.

The heat leak through support member 20 will be proportional to cross-sectional area of rod 22. Therefore, in order to minimize the cross section of rod 22 thereby minimizing the heat leak through the support member, it is preferred that rod 22 be hollow throughout its entire length. A cylindrical geometry for rod 22 results in a support that can carry tension, compression, bending and torsional loads. It is therefore preferred that rod 22 be tubular, sleeve 25 be annular and that plug 24 be cylindrical. It will be readily apparent to those skilled in the art that plug 24 may also be annular. A tubular section for rod 22 allows for the development of flexure and torsional stiffness while maintaining a small cross-sectional area. A metallic end connection for securing cryogenic support post 20 may be attached to tube 22 by shrinkfitting the cylindrical plug 24 and annular sleeve 25 to the tube 22.

In the preferred embodiment of the present invention, cylindrical plug 24 has a diameter greater than the inner diameter of tube 22 when both are at ambient temperature. The diameter of plug 24 is less than the inner diameter of tube 22 when plug 24 is cooled to a cryogenic temperature and tube 22 is maintained at ambient temperature. Sleeve 25 has an inner diameter which is slightly greater than the outer diameter of tube 22 when both are at ambient temperature. Preferably, the tolerances between the inner diameter of sleeve 25 and the outer diameter of tube 22 are such that a slide-fit is formed between the two surfaces at ambient temperature. First, sleeve 25 is inserted over one end of the tube 22 both being at ambient temperature. Plug 24 is cooled to a cryogenic temperature such that its diameter is now less than the inner diameter of tube 22. Plug 24 is next inserted inside the bore of tube 22 and inside sleeve 25, both of which are at ambient temperature. Plug 24 is allowed to equilibrate to ambient temperature, thereby expanding. Upon expansion of plug 24, tube 22 will be clamped between plug 24 and sleeve 25. This technique produces a non-invasive, thermally coupled joint between the metallic components 24 and 25 and the non-metallic tube 22 which is good in tension, compression, and flexure over temperature excursions well above and below the temperature at which the component parts were assembled to form the joint. The joint will be structurally sound to temperatures as low as liquid helium temperatures (4.2 K), well below the assembly temperature of the joint. It is preferred that the ambient assembly temperature be room temperature (300 K). However, it will be readily recognized by those skilled in the art that ambient assembly temperatures below and above room temperature may also be used.

The strength of the joint can be increased by increasing the amount of interference between the plug 24 and the other components. Additional strength can also be achieved by increasing the width (the dimension parallel to the sides of the tube) and the cylindrical length of the plug 24 and sleeve 25.

It is preferred that the non-metallic tube be made of fiber reinforced plastic material. Fiber reinforced plastic has good thermal properties for cryogenic purposes. The thermal properties of various FRP materials are given below in TABLE 1. Additionally, fiber reinforced plastic has good tensile and compressive properties. Also, a tube of FRP material can be easily manufactured.

TABLE 1

| FRP MATERIAL | | TEMPERATURE K 300–80 | 80–20 | 20–4.5 |
|---|---|---|---|---|
| G-10/G-11 | INTEGRATED THERMAL CONDUCTIVITY (W/cm) | 1.20 | 0.156 | 0.022 |
| CARBON COMPOSITE | INTEGRATED THERMAL CONDUCTIVITY (W/cm) | 4.56 | 0.22 | 0.012 |

The frictional forces that are developed between the FRP tube and the metallic components have yielded a remarkably strong joint. The frictional forces developed between the metallic components and the FRP tube, necessary to sustain an axial load by the support member, are dependent on the clamping forces between the FRP tube and the metallic components. However, due to the creep effects of the FRP material, an excessive clamping force may cause the FRP material to extrude out from between the metallic component.

A prototype of the support member of the present invention has been built and tested for structural integrity. Stress analyses have also been modeled on the prototype to determine the stresses developed in each component. A metallic plug was cooled to liquid nitrogen temperature (77 K) and inserted into a five inch diameter FRP tube and a stainless steel sleeve was disposed over the end of the tube. The prototype was tested to 10,000 pounds in both compression and tension. The stress analysis model reveals that the stresses developed in the FRP tube are substantially lower than the stresses developed in the metallic components. The model yielded a stress of 40,000 psi in the sleeve, 35,000 psi in the metallic plug, yet only a stress of 10,000 psi in the FRP tube.

A particular advantage of the support member of the present invention is that the member will not be weakened by operating at cryogenic temperatures. As discussed above, after the joint has been assembled, it can operate at temperatures well below the assembly temperature of any individual component without being weakened. If the same materials are used for both the sleeve and the plug, they will shrink at approximately an equal rate upon cooling. The joint will thus retain its original strength. By the proper choice of materials, the joint can be made stronger at cryogenic temperatures than at room temperature. By choosing a sleeve material which has a coefficient of thermal contraction greater than the coefficient of thermal contraction of the material used for the plug, the clamping force developed between the two components will increase upon cooling of the cryogenic support member. An example of suitable materials are a stainless steel plug combined with an aluminum sleeve.

To improve the heat interception between the ends of the support member and minimize heat conductance of the member, a heat sink or heat intercept can be made a part of the member. Contact developed by shrink-fitting a metallic plug and a metallic sleeve to the FRP tube develops a very efficient heat intercept. FIGS. 2 and 3, more particularly, show examples of such heat intercepts which are made part of cryogenic support member 20. A metallic plug 27 and a metallic sleeve 28 are shrink-fitted to FRP tube 22. The heat intercepts can be connected to thermal shields 12 and 17 as depicted in FIG. 1. The second end of the tube may contain a second metallic end connection to secure the support member. The second end connection may comprise a metallic disk 36 and metallic sleeve 35 and may be assembled to the tube 22 by a shrink-fit process similar to the one used to attach the first metallic end connection.

It will be readily apparent to those skilled in the art that additional strength for the joint can be obtained by selecting a sleeve which has an inner diameter less than the outer diameter of tube 22 when both are at ambient temperature and greater than the outer diameter of tube 22 when the sleeve is at a heated temperature and the tube is maintained at ambient temperature and heating the sleeve before disposing it over the end of the tube. Maximum clamping force in a shink-fit joint is obtained by a combination of cooling the plug and heating the sleeve. This process, however, requires additional care to assure that the FRP tube is not damaged by the heated sleeve. The damage may be minimized by quickly cooling the sleeve after it has been disposed over the ends of the tube.

The heat transfer between the ends of the support member is inversely proportional to the length of the support member. It is therefore desirable to maximize the length of the tube. Practical space requirements, however, dictate the actual length of the tube. In another preferred embodiment of the present invention, the effective length of the support member can be maximized such that the heat transfered through the support member is minimized, by coupling two concentric FRP tubes. In this embodiment, additional strength is desired at the shrink-fitted joints to accommodate for bending stresses developed at these joints. Therefore, the inner diameter of the sleeves is chosen to be less than the outer diameter of the tube to which they are mated when both are at ambient temperature and thus the sleeves must be expanded by heating prior to assembly.

Figure 4:
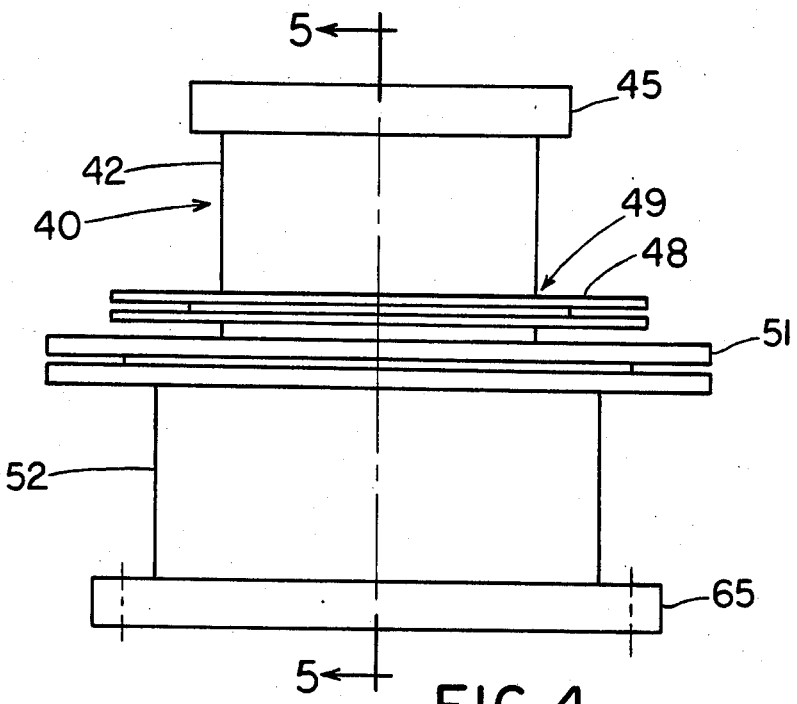
FIG. 4 represents a three-section reentrant tube support member of the present invention.
Figure 5:
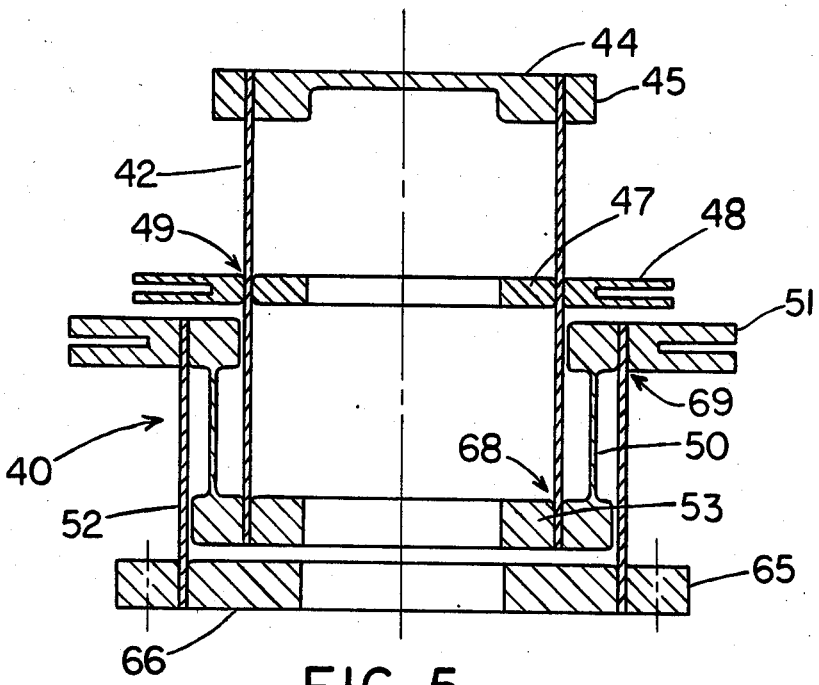
FIG. 5 represents a cross-sectional view through lines 5—5 of the cryogenic support member shown in FIG. 4.

Referring to FIGS. 4 and 5, support member 40 comprises a first non-metallic tube 42 coupled to a second non-metallic tube 52 by a metallic cylinder 50. A metallic end connection which comprises a metallic plug 44 and a metallic sleeve 45 is shrink-fitted to a first end of tube 42. Metallic cylinder 50 has an inner diameter which is smaller than the outer diameter of tube 42 when both are at ambient temperature and greater than tube 42 when the cylinder is at a heated temperature and the tube is at ambient temperature. Metallic plug 53 has an outer diameter which is greater than the inner diameter of tube 42 when both are at ambient temperature and less than the inner diameter of tube 42 when the plug is at a cryogenic temperature and the tube is at ambient temperature. The second end of tube 42 is disposed inside and encircled by metallic cylinder 50 at a heated temperature. Metallic plug 53 at a cryogenic temperature is inserted inside the second end of tube 42. Metallic plug 53 and metallic cylinder 50 are assembled to tube 42, and form metallic coupling 68, upon equilibrating of metallic plug 53 and metallic cylinder 50 to ambient temperature.

The outer diameter of metallic cylinder 50 is greater than the inner diameter of tube 52 when both are at ambient temperature and less than the inner diameter of tube 52 when the cylinder is at a cryogenic temperature and the tube is at ambient temperature. The inner diameter of metallic sleeve 51 is less than the outer diameter of tube 52 when both are at ambient temperature and greater than the outer diameter when the sleeve is at a heated temperature and the tube is at ambient temperature. Metallic cylinder 50 and tube 42 are cooled to cryogenic temperatures and disposed inside tube 52. Metallic sleeve 51 at a heated temperature is disposed over the first end of tube 52. Tube 52 is clamped between sleeve 51 and metallic tube 50, and form metallic coupling 69, upon equilibrating of metallic tube 50 and metallic sleeve 51 to ambient temperature. Metallic sleeve 51 may also serve as a heat intercept junction along the heat conductive path of the cyrogenic support member. The effective heat conductive path length of support member 40 is increased by the length of metallic tube 50 between metallic coupling 69 and metallic coupling 68.

Support member 40 may also include a second heat intercept which comprises a metallic plug 47 and a third metallic sleeve 48 shrink-fitted to tube 42.

Support member 40 may also include a second metallic end coupling for securing the support member connected to the second end of tube 52. This metallic end coupling may comprise a metallic plug 66 and a fourth metallic sleeve 65 shrink-fitted to the second end of tube 52.

It is preferred that tube 42 be more rigid than tube 52. To achieve this, the fiber reinforced plastic material of tube 42 may be made of a carbon composite, while tube 52 may be made of a glass composite such as G-10 or G-11. In addition to having preferred structural properties, a carbon composite may have preferred thermal properties at low temperatures. These thermal properties can be advantageously used in tube 42 which will operate at lower temperatures than tube 52 in the cryogenic system.

Figure 7:
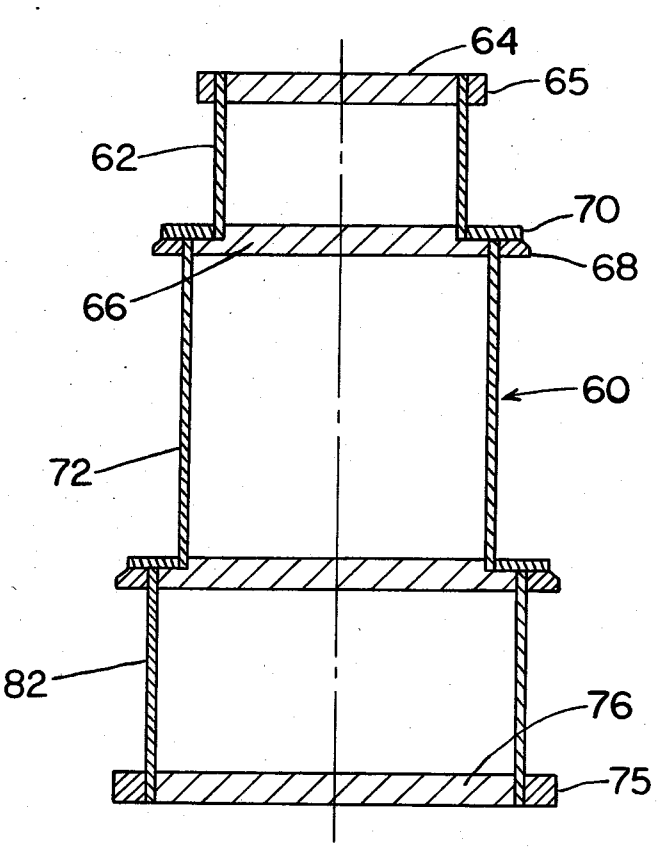
FIG. 7 represents a cross-section through lines 7—7 of the cryogenic support member shown in FIG. 6.
Figure 6:
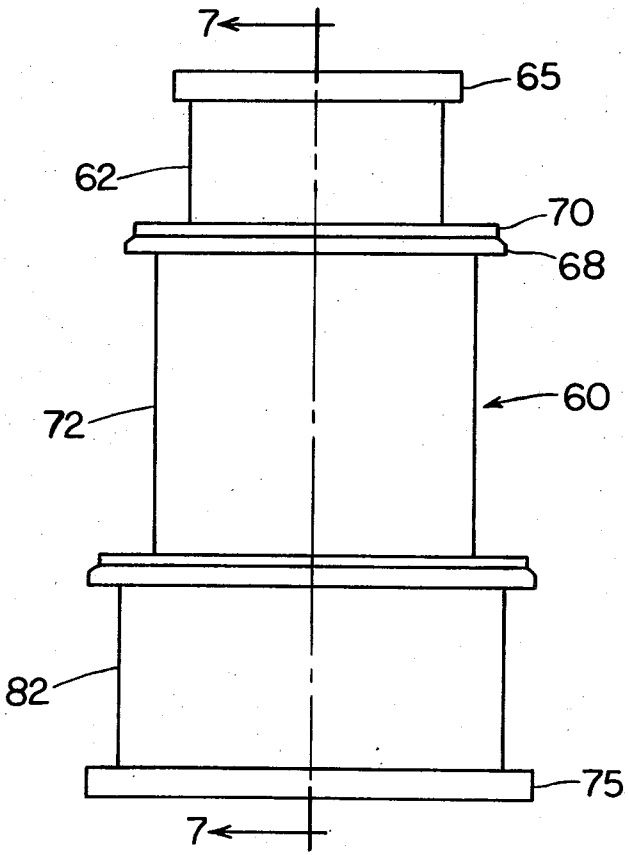
FIG. 6 represents a multi-section step tube, support member of the present invention.

Another preferred embodiment of the present invention is illustrated in FIGS. 6 and 7. Support member 60 may comprise multiple tubes, each tube being successively larger than the previous tube. A first tube 62 includes a metallic end connection which comprises a metallic plug 64 and a metallic sleeve 65 which are shrink-fitted to the tube 62. Tube 72 having a larger inner diameter than the outer diameter of tube 62 is coupled to tube 62 by metallic sleeves 68 and 70 and by a stepped cylindrical plug 66. Cylindrical plug 66 has a base having a diameter which is mateable with a second tube 72 and a step having a second diameter, smaller than the base diameter which is mateable with the first tube 62. Cylindrical plug 66 is shrink-fitted to tube 62 and tube 72 and to sleeves 70 and 68, such that tube 62 is coupled to tube 72. Additional tubes, such as 82, may be coupled to member 60 in a similar fashion. The tube may have a metallic end connection at the second end as depicted in FIGS. 6 and 7. The metallic end connection may comprise a metallic plug 76 and a metallic sleeve 75 shrink-fitted to the bottom of the last tube.

As an example, a post-type support was designed, built and evaluated both structually and thermally. The post evaluated employed a single tube configuration with a connection to 4.2 K at the first metallic end connection, a 10 K heat intercept, an 80 K heat intercept, and a second metallic end connection at 300 K. The post was designed, essentially, to the criteria for the SSC magnetic cryostat. The construction details of a typical post are given by the Table 2.

TABLE 2

| ELEMENT | MATERIAL (1) | L (mm) | OD × t (mm × mm) | 300K RADIAL INTERFERENCE (mm) | CONTACT PRESSURE (MPa) |
|---|---|---|---|---|---|
| 300K Connection | | | | | |
| plug | 316SST | 25.4 | 146.6 | | |
| sleeve | 316SST | 25.4 | 203.2 × 25.7 | 0.635 | 175.0 |
| 300–80K Tube | G10 | 42.9 | 152.4 × 3.2 | — | — |
| 80K Intercept | | | | | |
| plug | 6061T6A1 | 12.7 | 146.7 | | |
| sleeve | 6061T6A1 | 15.9 | 221.4 × 34.5 | 0.368 | 67.7 |
| 80–10K Tube | G10 | 85.7 | 152.4 × 3.2 | — | — |
| 10K Intercept | | | | | |
| plug | 6061T6A1 | 12.7 | 146.7 | | |
| sleeve | 6061T6A1 | 15.9 | 196.0 × 21.8 | 0.432 | 64.1 |
| 10–4.5K Tube | G10 | 42.9 | 152.4 × 3.2 | — | — |
| 5.4K Connection | | | | | |
| plug | 316SST | 25.4 | 146.6 | | |
| sleeve | 316SST | 25.4 | 203.2 × 25.7 | 0.635 | 175.0 |

Prior to the manufacture of the model post prototypes of the metallic end connections and the heat intercept junctions were made and tested. The heat intercept junctions were operated in both tension and compression to 10,000 kg, at both 300 and 80 K. The junctions exhibited no axial slippage and no signs of mechanical damage. The test of the samples were repeated after a period of 10 months with no changes in results. A metallic end connection was operated in tension to 10,000 kg load, at both 300 and 80 K. The sample exhibited no axial slippage and no sign of mechanical damage.

An assembled post was also tested. The testing consisted of tension of 5,000 kg load at both 80 and 300 K and bending at 300 K with a lateral 1,350 kg load equal to 46 cm above the bottom metallic end junction. One post was loaded in bending to 2,050 kg at 300 K. The post exhibited no axial slippage and no signs of mechanical damage. The model was also load cycled at 300 K to determine its tensile and flexure moduli.

A post, instrumented with temperature sensors, was installed and evaluated in a specially configured heat leak measurement dewar. The post had ends at 300 and 4.5 K with intercepts at 80 K and 10 K. The heat intercepting approximates "ideal" conditions since it provides thermal contact between the intercept rings and the heat sink around the entire perimeter of the rings. The heat flow to 4.5 K was measured by means of a heat leak meter. The measured and predicted temperature profiles and heat leak to the cold end were in good agreement. A measured heat leak of 25 mW to 4.5 K demonstrated that small heat leaks to 4.5 K can be achieved.

The disclosed support member thus provides an effective cryogenic support member. A cylindrical section results in a support that can carry tension, compression, bending, and torsional loads. The use of FRP materials with effective heat intercepts results in predictively lower heat leaks. The support member can be easily installed and adjusted. The tubing of the support post is not machined or penetrated, but only clamped between the metallic elements. The strength of the junction can be controlled by material selection, amount of interference employed, and surface treatment of the mating surfaces. By proper selection of materials, the junction becomes stronger as it becomes colder due to the added clamping afforded by the differential thermal contraction of the members. The heat intercept junctions provide a tightly clamped, reliable connection between the tubing and the metallic heat intercepts.

The foregoing description of the preferred embodiments of the invention have been presented for purposes of illustration and description. It is not intended to be exhaustive or to limit the invention to the precise forms disclosed, and obviously many modifications and variations are possible in light of the above teaching. The other embodiments were choosen and described in order to better explain the principal of the invention and its practical applications to thereby enable others skilled in the art to best utilize the invention in various embodiments and with narrow modifications as are suited to the particular use contemplated. It is intended that the scope of the invention be defined by the claims appended hereto.

The embodiments of this invention in which an exclusive property or privelege is claimed are defined as follows:

1. A cryogenic support member for restraining a cryogenic system comprising;

a rod having a depression at a first end, said rod being made of non-metallic material, said non-metallic material having an effectively low thermal conductivity;

a metallic plug; and a metallic sleeve, said plug and said sleeve shrink-fitted to the depression in said rod and assembled thereto such that said plug is disposed inside the depression of said rod, said sleeve is disposed over the depression in said rod and said rod is clamped therebetween, the shrink-fit clamping said rod being generated between said metallic plug and said metallic sleeve.

2. The cryogenic support member of claim 1 further comprising means for securing said support member to said cryogenic system.

3. The cryogenic support member of claim 1 wherein said rod is a tube having an inner diameter and an outer diameter, said plug is cylindrical and said sleeve is annular.

4. The cryogenic support member of claim 3 wherein the inner diameter of said sleeve is slightly greater than the outer diameter of said tube, said sleeve being disposed over the first end of said tube and wherein at ambient temperature the diameter of said plug is greater than the inner diameter of said tube and at a cryogenic temperature is less than the inner diameter of said tube, said plug at a cryogenic temperature being disposed inside the first end of said tube and assembled thereto upon expansion of said plug between said cryogenic and ambient temperatures.

5. The cryogenic support member of claim 4 further comprising;

a second annular metallic sleeve having an inner diameter slightly greater than the outer diameter of said non-metallic tube, said sleeve disposed over the second end of said non-metallic tube;

a second non-metallic tube having an inner diameter greater than the outer diameter of said first non-metallic tube;

a third annular metallic sleeve having an inner diameter slightly greatly than the outer diameter of said second non-metallic tube, said third sleeve disposed over a first end of said second non-metallic tube; and a stepped cylindrical metallic plug having a base and a step, said base at ambient temperature having a diameter greater than the inner diameter of said second tube and at a cryogenic temperature less than the inner diameter of said second tube and said step at ambient temperature having a diameter greater than the inner diameter of said first tube and at a cryogenic temperature less than the inner diameter of said first tube, wherein said base being at a cryogenic temperature, is disposed inside the first end of said second tube and said step is disposed inside the second end of said first tube and assembled to said first and said second tubes upon expansion of said stepped plug between said cryogenic and ambient temperatures.

6. The cryogenic support member of claim 5 wherein said first non-metallic tube and said second non-metallic tube are made of a fiber reinforced plastic.

7. The cryogenic support member of claim 4 further comprising a second metallic plug having approximately the same dimensions as said first metallic plug and a second metallic sleeve having approximately the same dimensions as said first metallic sleeve, said second plug and said second sleeve being shrink-fitted and assembled to the second end of said tube.

8. The cryogenic support member of claim 7 wherein said cryogenic temperature is approximately 77 K.

9. The cryogenic support member of claim 8 wherein said first and second metallic plugs and said first and second metallic sleeves are made from a material selected from a group consisting of aluminum or stainless steel.

10. The cryogenic support member of claim 8 wherein said metallic plugs are made of stainless steel and said metallic sleeves are made of aluminum.

11. The cryogenic support member of claim 7 wherein said tube material is fiber reinforced plastic.

12. The cryogenic support member of claim 11 further comprising a least one heat intercept means disposed between the ends of said tube.

13. The cryogenic support member of claim 12 wherein said heat interceptive means comprises a third metallic plug having a diameter at ambient temperature greater than the inner diameter of said FRP tube and at a cryogenic temperature less than the inner diameter of said FRP tube and a third metallic sleeve having an inner diameter sligthly greater than the outer diameter of said tube, said third plug and said third sleeve being shrink-fitted to said tube.

14. The cryogenic support member of claim 4 further comprising:

a second non-metallic tube having an inner diameter larger than the outer diameter of said first non-metallic tube;

a metallic tube having an inner diameter at ambient temperatures less than the outer diameter of said first non-metallic tube and at a heated temperature greater that the outer diameter of said first non-metallic tube and said metallic tube having an outer diameter at ambient temperature greater than the inner diameter of said second non-metallic tube and at a cryogenic temperature less than the inner diameter of said second non-metallic tube;

a second metallic cylindrical plug having approximately the same dimensions as said first plug;

a second annular metallic sleeve having an inner diameter at ambient temperature less than the outer diameter of said second non-metallic tube and at a heated temperature greater than the outer diameter of said second non-metallic tube;

wherein the second end of said first non-metallic tube is disposed inside said metallic tube, said metallic tube being at a heated temperature and said second metallic plug at a cryogenic temperature is disposed inside said first non-metallic tube and assembled thereto upon equilibrating of said metallic tube and plug to ambient temperature and wherein said metallic tube at a cryogenic temperature is disposed inside said second non-metallic tube and said second metallic sleeve at a heated temperature is disposed over said second non-metallic tube and assembled thereto upon equilibrating of said metallic tube and said second metallic sleeve to ambient temperature.

15. The cryogenic support member of claim 14 wherein the cross-section of said metallic tube is substantially I-shaped.

16. The cryogenic support member of claim 15 wherein the end of said metallic tube mated to said second metallic plug has an outer diameter less than the inner diameter of said second non-metallic tube and wherein the end of said metallic tube mated to said second metallic sleeve has an inner diameter less than the outer diameter of said first non-metallic tube.

17. The cryogenic support member of claim 16 wherein said first non-metallic tube and said second non-metallic tube are made of fiber reinforced plastic.

18. The cryogenic support member of claim 17 wherein said FRP material for said first tube is a carbon composite and wherein said FRP material for said second tube is a glass composite.

19. A shrink-fit method of joining a fiber reinforced plastic rod having a depression at one end, to a metallic end connection comprising the steps of;

(a) disposing an annular metallic sleeve over the end of said rod, said sleeve having an inner diameter sligthly greater than the outer diameter of said rod;

(b) cooling to a cryogenic temperature a metallic plug, said plug having an outer dimension greater than the inner dimension of said depression at ambient temperature and being mateable thereto;

(c) disposing said plug inside the depression in said rod, and (d) equilibrating said plug to ambient temperature whereby said rod is clamped between said plug and said sleeve.

* * * * *